US005323629A

United States Patent [19]

Aurich et al.

[11] Patent Number: 5,323,629

[45] Date of Patent: Jun. 28, 1994

[54] APPARATUS AND METHOD FOR TREATMENT OF YARN IN PACKAGE FORM

[75] Inventors: Christoph W. Aurich, Clemson, S.C.; Charles R. Hornbuckle, Lincolnton, N.C.

[73] Assignee: Gaston County Dyeing Machine Co., Stanley, N.C.

[21] Appl. No.: 942,306

[22] Filed: Sep. 9, 1992

[51] Int. Cl.[5] ..... D06B 3/09

[52] U.S. Cl. ..... 68/27; 68/184; 68/189

[58] Field of Search ..... 68/27, 189, 184, 190, 68/198; 8/158

[56] References Cited

U.S. PATENT DOCUMENTS

| | | | |
|---|---|---|---|
| 836,101 | 11/1906 | Dumons | 68/27 |
| 1,334,526 | 3/1920 | Dudley | 68/189 X |
| 1,789,953 | 1/1931 | Jefferson . | |
| 2,342,183 | 2/1944 | Dunn et al. | 68/189 X |
| 2,936,212 | 5/1960 | Karrer . | |
| 3,145,555 | 8/1964 | Krantz | 68/189 |
| 3,199,752 | 8/1965 | Casse | 68/189 |
| 3,360,968 | 1/1968 | Swindall et al. | 68/189 |
| 3,635,053 | 1/1972 | Daniel . | |
| 3,692,464 | 9/1972 | Furness . | |
| 3,751,223 | 8/1973 | Bergholtz . | |
| 3,967,923 | 7/1976 | Ameling | 68/189 |
| 3,969,074 | 7/1976 | Chung | 68/27 |
| 4,097,232 | 6/1978 | Negola et al. . | |
| 4,881,384 | 11/1989 | Chicharro . | |

FOREIGN PATENT DOCUMENTS

| | | | |
|---|---|---|---|
| 2450981 | 5/1976 | Fed. Rep. of Germany | 68/189 |

*Primary Examiner*—Frankie L. Stinson

*Attorney, Agent, or Firm*—Shefte, Pinckney & Sawyer

[57] ABSTRACT

An apparatus for treating textile yarn in package form is disclosed having a kier for supporting yarn packages for treatment therein, a pump connected to the kier for pumping treating liquor to the kier to treat yarn packages supported therein, an expansion tank connected to the kier for receiving treating liquor from the kier and connected to the pump for passage of treating liquor from the expansion tank to the pump for recirculation to the kier, a device for supporting yarn packages in the expansion tank, valving operable for alternatively using the expansion tank as a kier and the kier as an expansion tank. The kiers and expansion tank are of differing capacities to accommodate varying load sizes at minimum liquor ratios. The heat exchangers are also of differing capacities for more efficient operation of the system.

8 Claims, 6 Drawing Sheets

APPARATUS AND METHOD FOR TREATMENT OF YARN IN PACKAGE FORM

FIELD OF THE INVENTION

This invention relates generally to the treatment of yarn in package form and, more particularly, to a new apparatus and method for maximizing treating equipment utilization and minimizing treating liquor utilization during treatment of yarn in package form.

BACKGROUND OF THE INVENTION

The treatment of yarn in package form may involve washing, bleaching, dyeing, rinsing or other liquid treatment. The yarn is typically wound on dye tubes as yarn packages and placed on a series of spindles or other core members within a treatment chamber. The yarn treating liquid is circulated into the treatment chamber and through the packages of yarn at elevated temperatures and pressures. The heated liquid under pressure penetrates the package and the individual strands of yarn or fibers fully or to a predetermined depth for special effects. The treating liquid is typically forced from the spindle or core member into the inside of the tube outwardly through the yarn, and in some systems the treating liquid is forced from outside the package inward through the package into the core member.

A problem with previous package dyeing systems is that it has not been practically feasible to vary the amount of treatment liquor for optimum usage with loads of yarn varying from a standard capacity of the system. This use of oversized equipment for small loads is both expensive and environmentally unsound because of the need to fill the kiers with the same amount of liquor as for full sized loads.

In other types of textile dyeing systems, for example dye becks for treating lengths rather than packages of textile material, where relatively large dye becks are standard in the art and are designed to handle several hundred yards of material bunched in rope form, conversion systems, such as disclosed in U.S. Pat. No. 3,635,053, have been developed for changing the capacities of such large dye becks by employing a number of relatively small dye becks constructed and designed to be fitted into the standard large dye beck in a side-by-side relation so that separate dyeing operations can be carried out in each of the smaller dye becks simultaneously. However, a satisfactory practical method and apparatus for selectively varying the capacities in package dyeing systems to adjust to loads varying from a standard load are not known.

SUMMARY OF THE INVENTION

It is an object of the present invention to provide a method and an apparatus for treating textile yarn in package form.

This and other objects of the present invention are accomplished with an apparatus for treating textile yarn in package form having a kier for supporting yarn packages for treatment therein, a pump connected to the kier for pumping treating liquor to the kier to treat yarn packages supported therein, an expansion tank connected to the kier for receiving treating liquor from the kier which is connected to the pump for passage of treating liquor from the expansion tank to the pump for recirculation to the kier. Additionally, a device for supporting yarn packages in the expansion tank is included for use of the expansion tank as a kier and a device for alternatively connecting the pump to the kier for pumping treating liquor to the kier or to the expansion tank for pumping treating liquor thereto for use of the expansion tank as a kier to treat yarn packages supported therein. Additionally, valving is provided to selectively connect the kier between the pump and the expansion tank for use of the kier as an expansion tank when the expansion tank is being used as a kier.

Preferably, the expansion tank is formed with a treating capacity different from that of the capacity of the kier, usually with the expansion tank having a smaller treating capacity than the kier. At least two heat exchangers of differing capacities as well as a device for selectively connecting one or more heat exchanger between the pump and the alternatively connecting device for selectively connecting the heat exchangers to the kier or to the expansion tank is preferably included. The selectively connecting device may comprise a reverse valve and the pump may comprise a variable speed pump.

The kier may comprise at least two separable sections having cylindrical portions with annular ends as well as a device releasably connecting the sections together at their annular ends in a pressure seal, and at least one cylindrical module insertable between the annular ends of the sections to expand the volume of the kier and a device for releasably connecting the module to the annular ends of the sections in a pressure seal.

In one form of the invention, there is a plurality of kiers for supporting yarn packages for treatment therein, with at least two heat exchangers, a pump for pumping treating liquor through the heat exchangers and the plurality of kiers to treat yarn packages supported in the kiers, as well as an expansion tank connected to the kiers for receiving treating liquor from the kiers and connected to the pump for passage of treating liquor from the expansion tank to the pump for recirculation to the kier. A device for connecting one or more selected ones of the heat exchangers between the pump and one or more selected ones of the kiers is provided. At least one of the kiers may be of a different capacity than at least another of the kiers and at least one of the heat exchangers may be of a different capacity than another of the heat exchangers. Once again, the connecting means may comprise a reverse valve and the pump may comprise a variable speed pump. With this arrangement a selected capacity operation can effectively be accommodated efficiently.

A feature of the present invention is the forming of the kier in at least two separable sections having cylindrical portions with annular ends, means releasably connecting the sections together at their annular ends in a pressure seal. At least one cylindrical module is insertable between the annular ends of the sections to selectively expand the volume of the treatment chamber. A device releasably connects the module to the annular ends of the sections in a pressure seal.

Another feature of the present invention is forming the kier with a cylindrical central portion having an upper annular rim and a lower annular rim, a removable circular lid portion secured in a pressure seal to the upper rim of the central portion, the lid portion having a relatively flat underside in proximity to the supported yarn packages. Also included is a circular lower portion formed in a pressure seal to the lower rim of the central portion, the lower portion having an inner upper facing side formed complementary to the base of the carrier supporting yarn packages in the kier, whereby the volume of liquor needed to fill the kier during package treatment is minimized. For reinforcement of the lid and the lower portion, they are formed with radially extending exterior reinforcing ribs.

The method for treating textile yarn in package form of the present invention comprises the steps of pumping a treating liquor through a heat exchanger to at least one kier and selectively pumping the treating liquor through another heat exchanger to an expansion tank for use of the expansion tank as a kier.

DETAILED DESCRIPTION OF THE INVENTION

Figure 1:
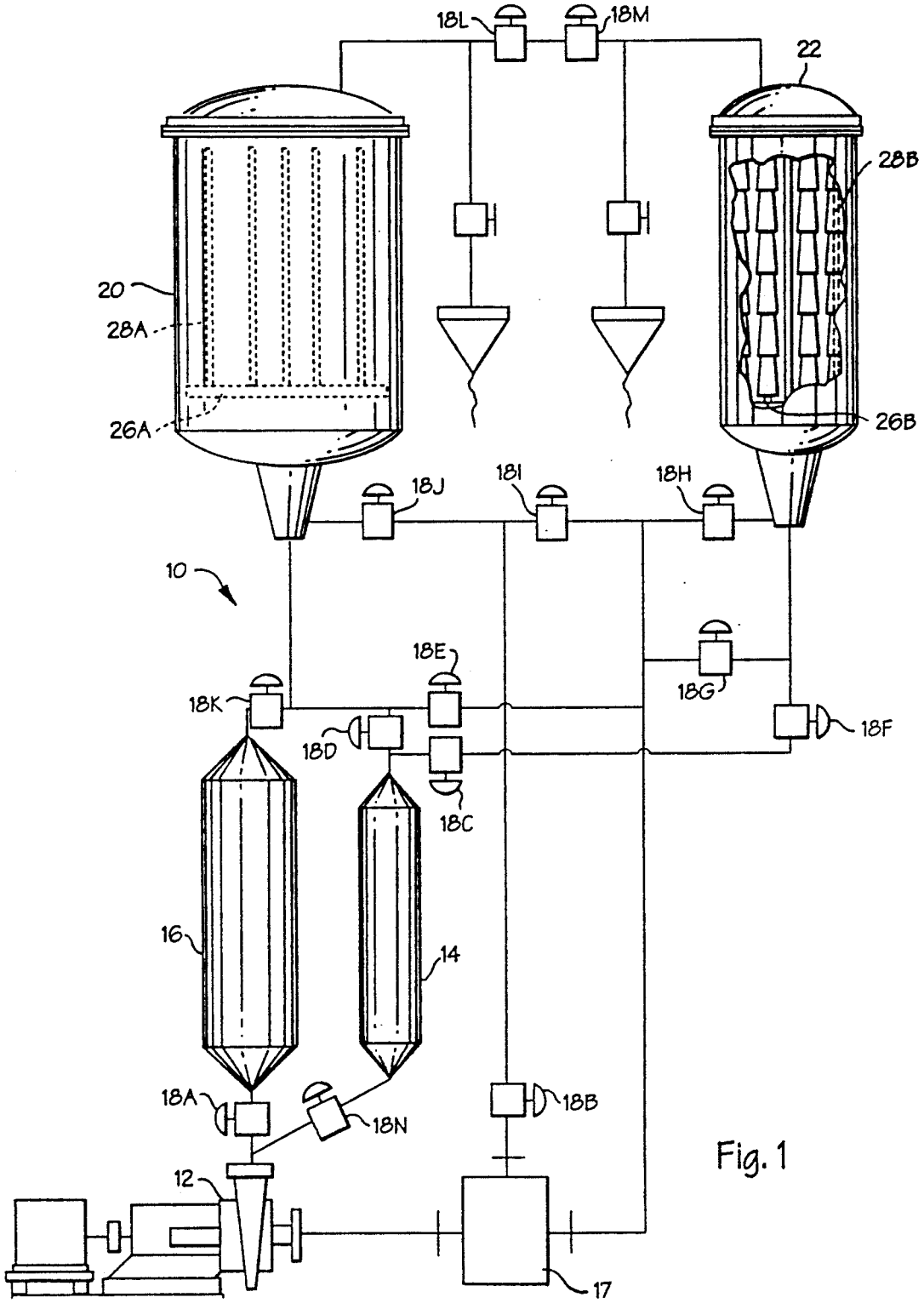
FIG. 1 is a schematic illustration of a package dyeing machine embodying a first embodiment of the present invention.

Referring now to FIG. 1, a first embodiment of the present invention is shown in the form of a package dyeing machine 10 having a pump 12 which is connected to a kier 20 and an expansion tank 22 via heat exchangers 14 and 16. The heat exchangers may be of a similar size but are preferably of differing sizes in order to increase efficiency depending on the treatment load. The pump pumps treating liquor through the yarn packages. Kier 20 carries the yarn packages mounted on a conventional carrier 26 when a full capacity load of yarn packages are to be treated or a smaller number of yarn packages may be located on a carrier in the expansion tank 22 for treatment. Two return lines 15 from kier 20 and expansion tank 22 to the pump 12 through a reservoir 17 are included in the assembly of FIG. 1. When the expansion tank 22 is used as a kier only one return line is necessary to handle the return flow. However, when the larger capacity kier 20 is used as the treatment chamber, two return lines are preferred to handle the flow.

The yarn packages to be treated are supported within the kier 20 or expansion tank 22 on spindles of a carrier that include a treating liquid distributing manifold 26A and 26B, respectively, with a plurality of spindles 28A and 28B, respectively, rising therefrom towards the top of the kier or expansion tank.

In FIG. 1, the expansion tank 22 and the kier 20 are connected to each other, to the pump 12 and to the heat exchangers 14 and 16 via a conventional series of valves 18A–N. Through the opening and closing of the valves 18 in the configuration of FIG. 1, either the kier 20 or the expansion tank 22 can be selectively operated for treating textile yarn during a package treatment cycle. For example, if the number of packages to be treated is sufficient to use the kier 20, both heat exchangers 16 and 14 are selected for use and the expansion tank 22 operates as an expansion tank. Alternatively, in the mode specifically shown in FIG. 1, where a relatively small number of packages are to be treated, only the smaller heat exchanger 14 is connected for operation. Thus, in the mode specifically shown in FIG. 1, expansion tank 22 is used as the kier and kier 20 is used as the expansion tank.

In order to operate only the smaller heat exchanger 14 valve 18A is closed between heat exchanger 16 and pump 12 while valve 18N between the pump 12 and the small heat exchanger 14 is opened. This connects the pump solely to the smaller heat exchanger 14. Appropriate ones of valves 18B, 18C, 18F, 18M, 18H, and 18I are then opened and 18E, 18K, 18J and 18L closed to allow for treatment of the small quantity of yarn packages 24 in the expansion tank 22 and operation of the kier 20 as an expansion tank rather than as a kier. Thus, if a small load of textile yarn in package form is to be treated, greater efficiency can be obtained through use of only the small heat exchanger 14. Additionally, less dye is used by use of the smaller expansion tank as a kier.

When the kier 20 bears the yarn packages 24 to be treated, the additional amount of treating liquor required may at times result in the need for both heat exchangers 14 and 16 to be used rather than using only the large heat exchanger 16. It is preferable that the expansion tank 22 and the kier 20 as well as the heat exchangers are of differing sizes and selectively usable as shown in FIG. 1 to maximize the versatility and efficiency of the system.

The assembly may be operated in a conventional manner with the kier 20 and expansion tank 22 performing their conventional function. Then, when a small load is to be treated the functions can be reversed. In this operation, the assembly 10 is first pressurized, then the expansion tank 22 is filled with the dye liquor and the whole system is filled with dye liquor. Once the system is heated to operating temperature, the heat causes the liquor to expand and this expansion flows over into the kier 20, which is operating as the expansion tank.

Figure 2:
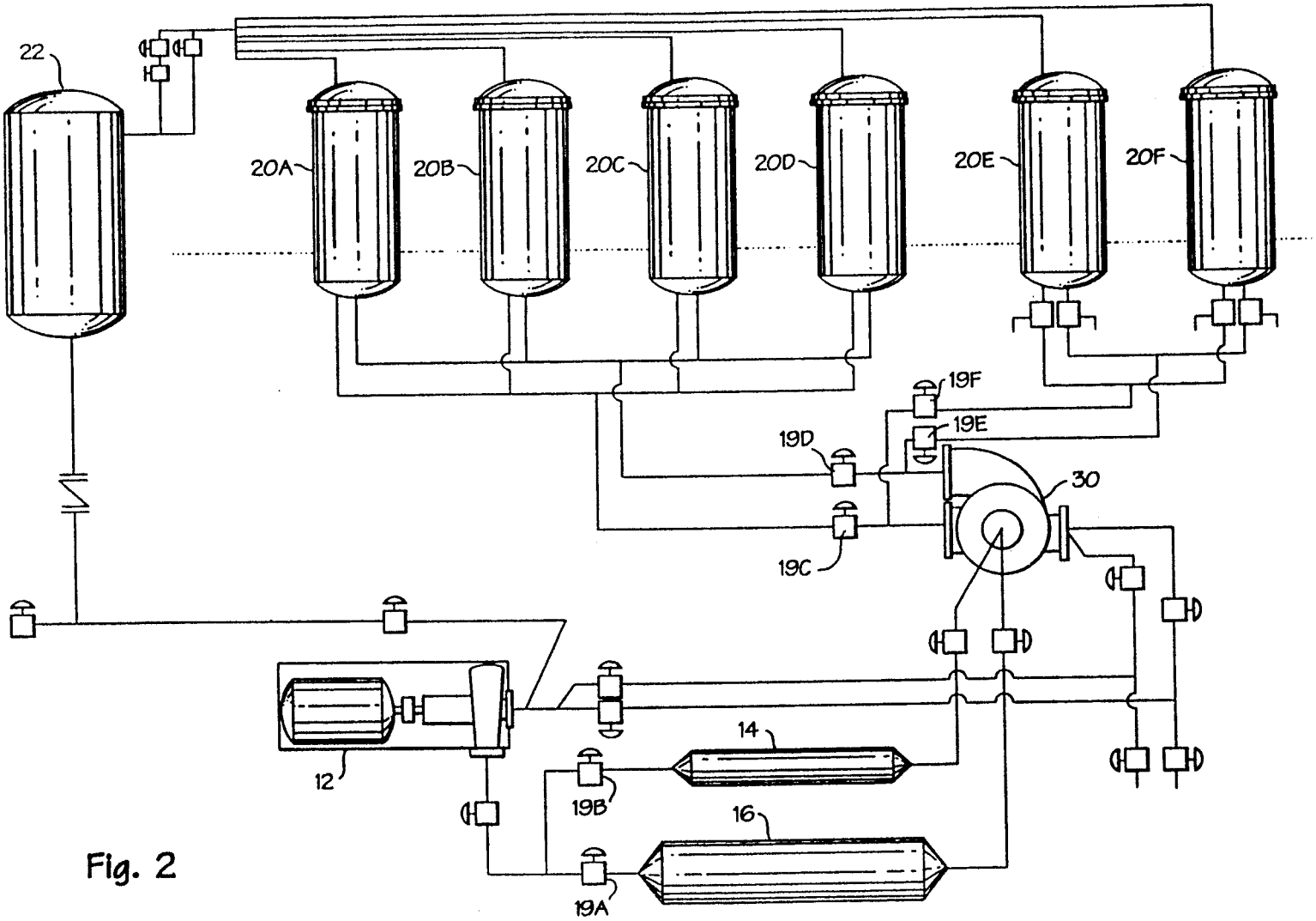
FIG. 2 is a schematic illustration of a package dyeing machine embodying a second embodiment of the present invention operating in a first mode.

A reverse valve, such as the reverse valve 30 in the embodiment of FIG. 2, may be employed reversibly to permit operation either to circulate the dye liquor through the manifolds 26A and 26B and the spindles 28A and 28B into the interior of the yarn packages and then through the packages to the exterior of the packages and drained down to the pump 12, or, alternatively, to circulate the dye liquor into the kier outside the yarn packages, through the yarn packages, into the spindles and manifold and then to the return lines to the pump.

The valves 18L and 18M in the valving connecting the kier 20 to the expansion tank 22 are to permit draining of wash water after the dyeing operation and while the system is being cleaned.

One of the advantages of using two heat exchangers of different capacities is that after the system is heated to operating temperature using the large capacity heat exchanger the system can be switched over to the small capacity heat exchanger to maintain the operating temperature to obvious advantage.

Referring now to FIG. 2 another embodiment of the present invention is shown. In this embodiment the invention has six kiers 20A through 20F and an expansion tank 22. Once again the pump is connected to the kiers via heat exchangers 14 and 16. The heat exchangers are preferably connected to kiers 20A through 20F via reverse valve 30 of the type previously discussed. In the embodiment shown in FIG. 2, only one kier 20F or any number of the kiers 20A-20F which are of the same capacity may be employed during a package treatment cycle. Thus, the pump 12 and heat exchangers may service only one kier or up to six or more kiers. If a relatively small load is being treated, less than all the kiers will be used and only the smaller heat exchanger 14 need be utilized. Alternatively, if a larger load is being treated, kiers 20A through 20F may be employed, along with either both or only the larger heat exchanger 16, by opening and closing the appropriate valves 19A, 19B, 19C, 19D, 19E and 19F to allow the reverse valve 30 to feed the treating liquor to kiers 20A through 20F. For example, the valving can be operated to connect both heat exchangers to all six kiers, or the large heat exchanger 16 may be connected to five kiers, such as 20A through 20E or 20F, or the large heat exchanger 16 may be connected to the four kiers 20A through 20D, or the small heat exchanger 14 may be connected to either or both kiers 20E and 20F.

Figure 3:
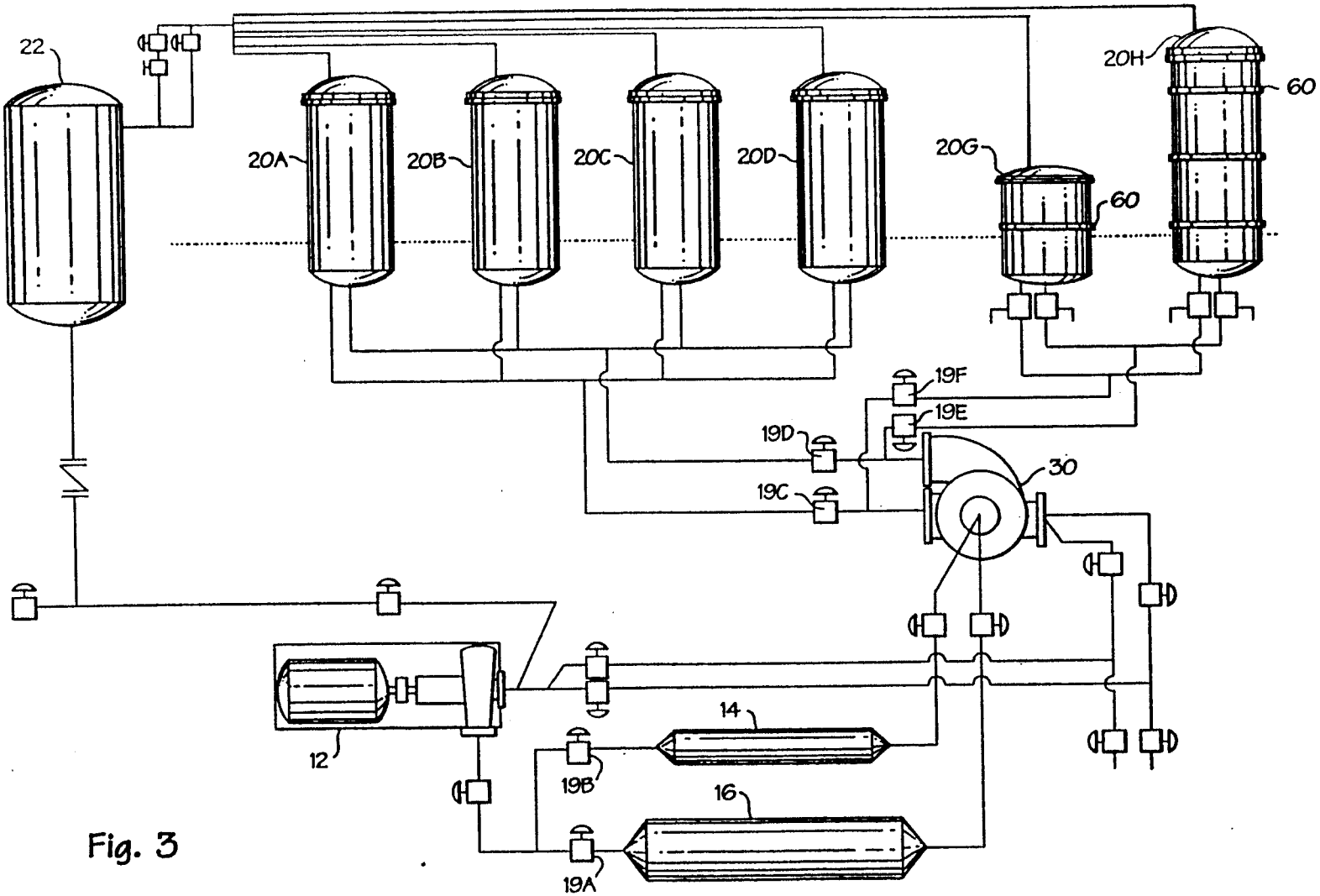
FIG. 3 is a view similar to FIG. 2 illustrating a variation of the second embodiment of the present invention.

In yet another mode of operation seen in FIG. 3, which is the same arrangement as FIG. 2 except that the kiers 20 are not all the same size, some of the kiers 20A through 20D, 20G and 20H may employ the undersized 20G and/or oversized 20H type kiers to suit the quantity of packages being treated. Thus, efficient use of treating liquor and energy is provided by the ability to alternate use of a particular number and size of kiers and by the utilization of particular appropriately sized heat exchangers. The sizes of kiers 20G and 20H may be varied by the insertion of modules between the connecting flanges 60 thereof as further described with respect to FIGS. 7 and 8.

Figure 4:
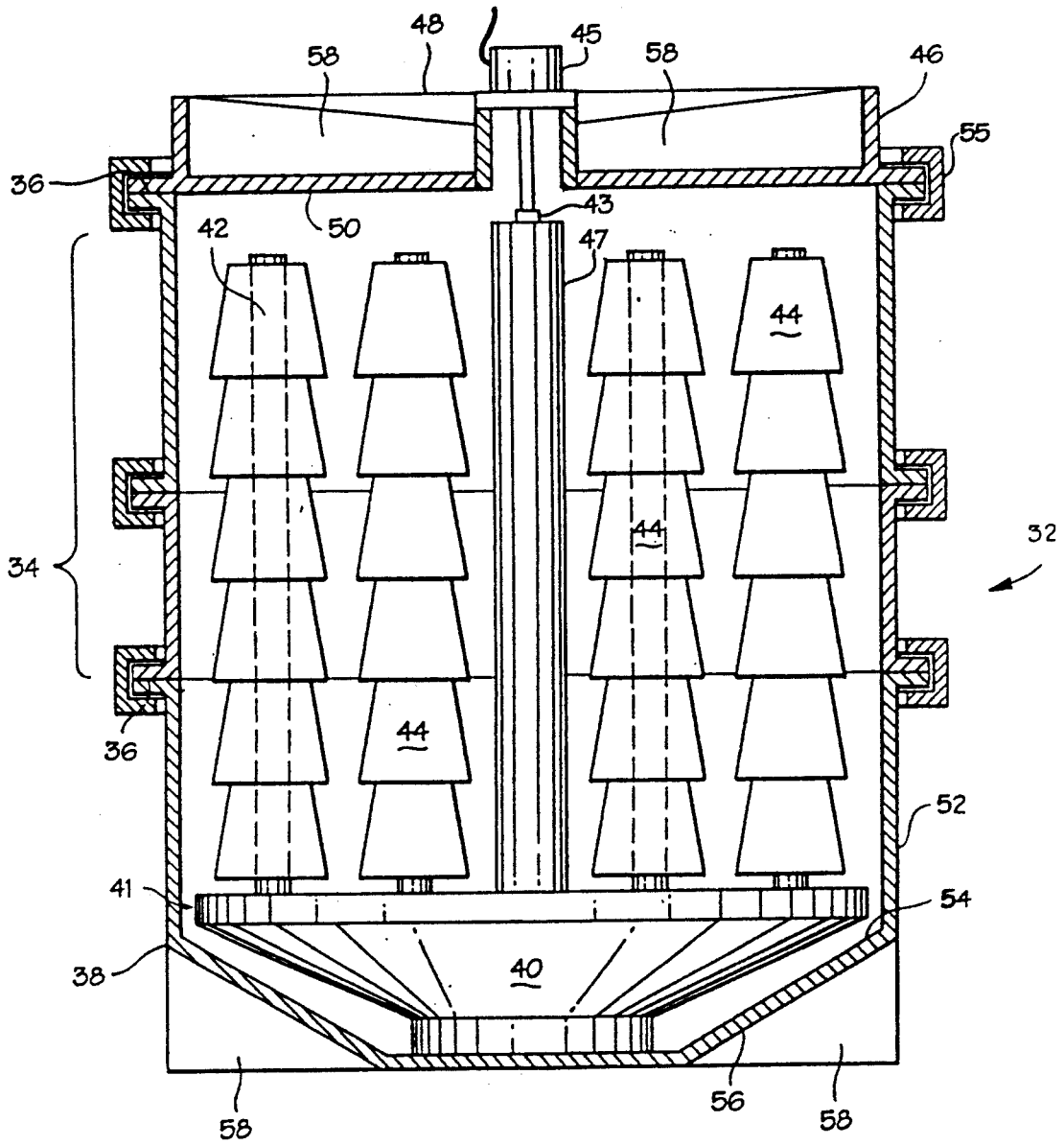
FIG. 4 is a vertical sectional view of a kier of a package dyeing machine of the present invention.
Figure 5:
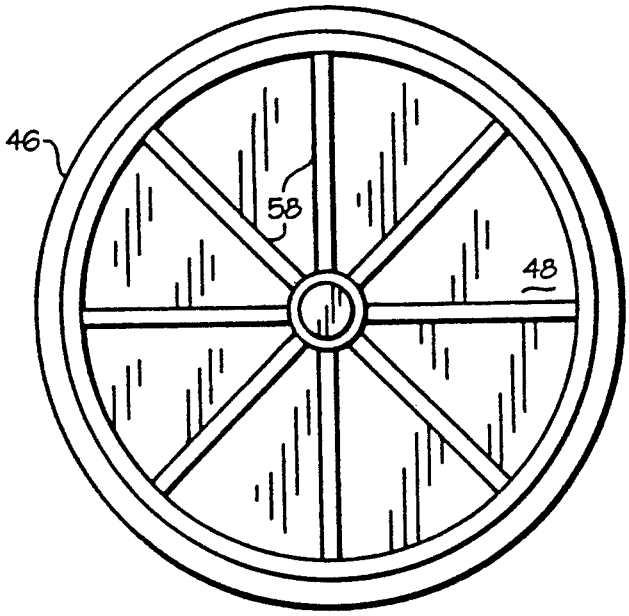
FIGS. 5 and 6 are top and bottom plan views of the kier of FIG. 4, respectively.
Figure 6:
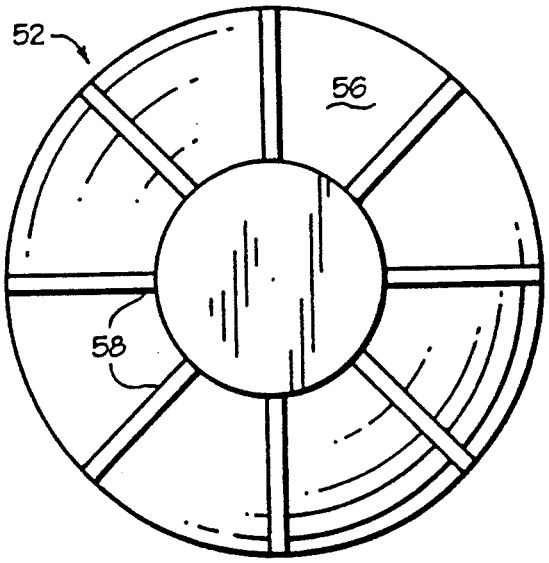

Referring now to FIGS. 4, 5 and 6, another embodiment of the present invention is shown. In this embodiment, a kier or expansion tank 32 is shown with a cylindrical central portion 34 having an upper rim 36 and a lower rim 38. Within the kier a carrier 41 for supporting yarn packages 44 in spool or tube form is situated and conventionally held in place by a ram 43 of a pneumatic piston/cylinder mechanism 45 mounted to the lid 50 and acting on the central standard 47 of the carrier 41. The device includes a carrier manifold 40 that has a series of perforated spindles 42 upon which tubes of yarn packages 44 are placed.

A removable circular lid portion 46 is secured to the upper rim 36 of the central portion 34. When in operation the lid 46 should be secured to the upper rim in a fluid tight relation by a locking band 55. The lid portion 46 has a top side 48 and a bottom side 50 with the bottom side being relatively flat and facing towards the central portion 34 to reduce the fill volume as compared to conventional disk shaped lids.

The kier or expansion tank also has a circular lower portion 52 secured to the lower rim 38 of the central portion 34 with the bottom of the lower portion 52 having an inner facing surface 54 and an outer facing surface 56. The inner facing surface 54 is formed to complement the underside of the carrier manifold 40. Thus, since the bottom surface 50 of the lid portion 46 and the inner facing surface 54 of the lower portion 52 are formed to complement the carrier of yarn packages, less treating liquor is needed to fill the pressure system than in a conventional system and the volume of liquor needed to fill the kier or expansion tank during package treatment is therefore minimized as is the energy needed to heat the liquor. Preferably, the lid 46 and lower 52 portions of the kier or expansion tank 32 bear radial reinforcing ribs 58 formed on the outer facing surfaces 56 of the portions, respectively, to compensate for the non-spherical shapes of the portions in resisting the operating pressure.

Figure 7:
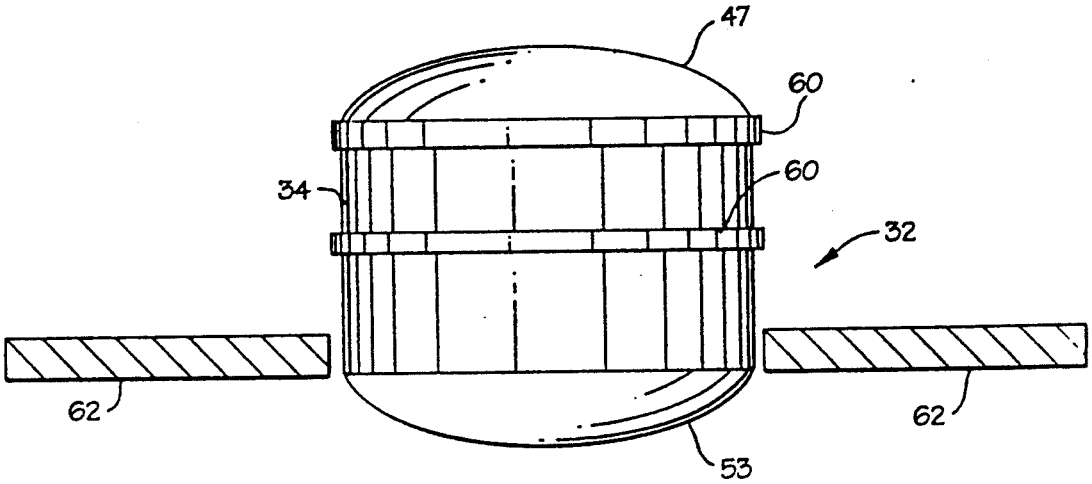
FIG. 7 is an elevational view of a kier of a package dyeing machine modified to have a transverse intermediate seam according to one form of the present invention.

Referring now to FIG. 7 yet another aspect of the present invention is shown. Here, a kier or expansion tank 32 having a cylindrical central portion 34 is shown with respect to a work floor 62. The kier or expansion tank 32 also has a lid portion 47 and a lower portion 53. The central portion 34 is connected to the lid 47 and lower 53 portions by conventional flange and locking band connections 60. The flange connections 60 allow for the separation and insertion of central portions 34 as intermediate modules to expand the capacity of the kier 32 as seen in FIG. 7.

Figure 8:
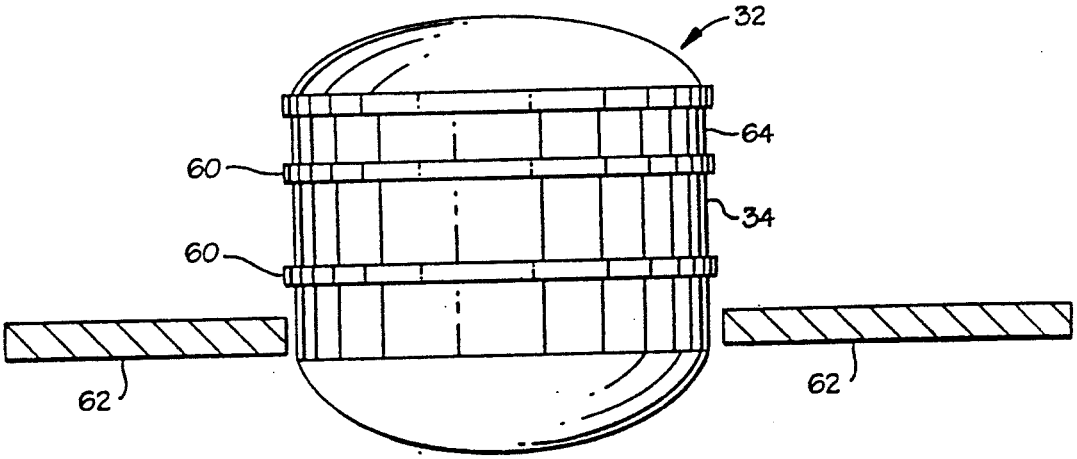
FIG. 8 is an elevational view of the kier of FIG. 6 with an intermediate module inserted therein.

Referring now to FIG. 8, an additional cylindrical module 64 is shown in its inserted position. The kier 32 is shown with respect to the work floor 62. Thus, in FIG. 8 the kier or expansion tank 32 can be easily expanded to accommodate larger size loads by insertion of intermediate modules 64. On the other hand, for smaller size loads the module can be removed and the kier used as shown in FIG. 7 for smaller loads. Of course, a series of modules 64 may be inserted for increased capacity.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. An apparatus for treating textile yarn in package form comprising:

a kier for supporting yarn packages for treatment therein;

pump means connected to said kier for pumping treating liquor to said kier to treat yarn packages supported therein;

an expansion tank connected to said kier for receiving treating liquor from said kier and connected to said pump means for passage of treating liquor from said expansion tank to said pump means for recirculation to said kier;

means for supporting yarn packages in said expansion tank for use of said expansion tank as a kier; and means for alternatively connecting said pump means to said kier for pumping treating liquor to said kier or to said expansion tank for pumping treating liquor thereto for use of said expansion tank as a kier to treat yarn packages supported therein.

2. The apparatus for treating textile yarn in package form of claim 1 wherein said alternatively connecting means connects said kier between said pump means and said expansion tank for use of said kier as an expansion tank when said expansion tank is being used as a kier.

3. The apparatus for treating textile yarn in package form of claim 2 wherein said expansion tank is formed with a treating capacity different than the capacity of said kier.

4. The apparatus for treating textile yarn in package form of claim 3 wherein said expansion tank has a smaller treating capacity than said kier.

5. The apparatus for treating textile yarn in package form of claim 4 further comprising at least two heat exchangers, other, means for selectively connecting said heat exchangers between said pump means and said kier or connecting said one heat exchanger between said pump means and said expansion chamber.

6. The apparatus for treating textile yarn in package form of claim 3 further comprising at least two heat exchangers of different capacities, means for selectively connecting one or more of said heat exchangers between said pump means and said alternatively connecting means for selectively connecting said heat exchangers to said kier or to said expansion tank.

7. The apparatus for treating textile yarn in package form of claim 1 wherein said pump means comprises a variable speed pump.

8. The apparatus for treating textile yarn in package form of claim 1 wherein said kier comprises:

at least two separable sections having cylindrical portions with annular ends;

means releasably connecting said sections together at their annular ends in a pressure seal;

at least one cylindrical module insertable between the annular ends of said sections to expand the volume of the kier; and means for releasably connecting said module to the annular ends of said sections in a pressure seal.

* * * * *

UNITED STATES PATENT AND TRADEMARK OFFICE

CERTIFICATE OF CORRECTION

PATENT NO. : 5,323,629

DATED : June 28, 1994

INVENTOR(S) : Christoph W. Aurich and Charles R. Hornbuckle

It is certified that error appears in the above-identified patent and that said Letters Patent is hereby corrected as shown below:

Column 7, line 17, after "exchangers," insert -- one of said heat exchangers having a smaller capacity than the --.

Signed and Sealed this

Thirty-first Day of January, 1995

*Attest:*

Bruce Lehman

BRUCE LEHMAN

*Attesting Officer*

*Commissioner of Patents and Trademarks*